US009187854B2

(12) United States Patent
Mota

(10) Patent No.: US 9,187,854 B2
(45) Date of Patent: Nov. 17, 2015

(54) COLLAR PRESS APPARATUS

(71) Applicant: Michael Anthony Mota, Mississauga (CA)

(72) Inventor: Michael Anthony Mota, Mississauga (CA)

( * ) Notice: Subject to any disclaimer, the term of this patent is extended or adjusted under 35 U.S.C. 154(b) by 0 days.

(21) Appl. No.: 14/678,999

(22) Filed: Apr. 5, 2015

(65) Prior Publication Data

US 2015/0284893 A1 Oct. 8, 2015

Related U.S. Application Data

(60) Provisional application No. 61/976,552, filed on Apr. 8, 2014.

(51) Int. Cl.

| | |
|---|---|
| ***D06C 15/00*** | (2006.01) |
| ***D06C 15/10*** | (2006.01) |
| ***A41B 3/00*** | (2006.01) |

(52) U.S. Cl.
CPC .. *D06C 15/10* (2013.01); *A41B 3/00* (2013.01)

(58) Field of Classification Search
CPC ..... D06C 15/10; D06F 71/22; A41B 3/00
USPC ..... 223/52.1–52.6
See application file for complete search history.

(56) References Cited

U.S. PATENT DOCUMENTS

| | | | | |
|---|---|---|---|---|
| 2,136,564 | A * | 11/1938 | Ricketson | 38/66 |
| 2,619,268 | A | 11/1952 | Asher | |
| 3,586,219 | A | 6/1971 | Radford et al. | |
| 3,851,807 | A | 12/1974 | Camp et al. | |
| 5,553,410 | A | 9/1996 | Derby | |
| 6,497,060 | B1 * | 12/2002 | Bolan et al. | 38/21 |
| 8,578,639 | B2 * | 11/2013 | Hurd | 38/13 |
| 2005/0029317 | A1 | 2/2005 | Devrick et al. | |
| 2012/0324769 | A1 * | 12/2012 | Hurd | 38/99 |
| 2013/0081212 | A1 * | 4/2013 | Sanders et al. | 8/137 |

* cited by examiner

*Primary Examiner* — Nathan Durham
(74) *Attorney, Agent, or Firm* — PATENTFILE, LLC; Bradley C. Fach; Steven R. Kick

(57) ABSTRACT

A collar press apparatus which in some embodiments may comprise a first casing member, a second casing member, a first press element, and a second press element. The first press element may comprise a first garment contacting surface which may be configured to be in thermal communication with a first side of a shirt collar, such as the exterior surface of a shirt collar, and which may be positioned proximate to the first casing member. The second press element may comprise a second garment contacting surface which may be configured to be in thermal communication with a second side of a shirt collar, such as the neck contacting or interior surface of a shirt collar, and which may be positioned proximate to the second casing member.

18 Claims, 9 Drawing Sheets

COLLAR PRESS APPARATUS

CROSS REFERENCE TO RELATED APPLICATIONS

This application claims priority to and the benefit of the filing date of U.S. Provisional Application No. 61/976,552, filed on Apr. 8, 2014, entitled "Fabric Collar Press formed by heat absorption used in a mechanical dryer", which is hereby incorporated by reference in its entirety.

FIELD OF THE INVENTION

This patent specification relates to the field of apparatuses configured to press portions of a garment. More specifically, this patent specification relates to apparatuses for use in press finishing of portions of a garment such as the collar of a shirt.

BACKGROUND

One of the more difficult operations in the laundering of dress shirts and other such garments comprising a collar is the pressing and preserving of the garment's collar. Maintaining the look of a pressed collar after laundering a dress shirt poses a challenge to the average individual. After being laundered and specifically after removal from a conventional clothes dryer, the collar is often deformed in shape and/or texture. To regain the pressed collar appearance, an individual may attempt to use a clothes iron to press and reshape the collar. Due to the curved nature of collars, this process often requires a significant amount of time, effort, and even frustration.

In order to avoid the time and effort required for pressing and reshaping the collars on garments, individuals may resort to using a laundry service. Typically, the laundry service uses a dedicated pressing machine to press these collars after washing and prior to pressing of the remaining portions of the garment resulting in a well pressed collar appearance. Unfortunately, laundry services tend not only to be relatively expensive, but they also require a relatively large amount of time from the garment's owner due to the laundering process and the required travel to drop off and pick up the garment.

Therefore, a need exists for novel apparatuses configured to press the collar of a shirt. There also exists a need for novel apparatuses which do not require a significant amount of time and effort in order to press the collar of a shirt. There is a further need for novel apparatuses configured to press the collar of a shirt that are able to produce a well pressed collar appearance without the time and expense associated with using a laundry service. Finally, there exists a need for novel apparatuses configured to press the collar of a shirt that are able to produce a well pressed collar appearance using a conventional clothes dryer.

BRIEF SUMMARY OF THE INVENTION

A collar press apparatus that is configured to press the collar of a shirt and is able to produce a well pressed collar appearance is provided. In some embodiments, the apparatus may comprise a first casing member, a second casing member, a first press element, and a second press element. The first press element may comprise a first garment contacting surface which may be configured to be in thermal communication with a first side of a shirt collar, such as the exterior surface of a shirt collar, and which may be positioned proximate to the first casing member. The second press element may comprise a second garment contacting surface which may be configured to be in thermal communication with a second side of a shirt collar, such as the neck contacting or interior surface of a shirt collar, and which may be positioned proximate to the second casing member. The first casing member and the second casing member may also comprise one or more fasteners which may be configured to removably couple the first casing member and the second casing member together.

In further embodiments, a collar press apparatus may comprise a first press element constructed from a thermally conductive material with a first garment contact surface suitable to transfer heat from the first press element to a shirt collar, such as to the exterior surface of a shirt collar, and a first casing member which may be coupled to the first press element with the first casing member being constructed from a non-thermally conducting material. The apparatus may further comprise a second press element constructed from a thermally conductive material with a second garment contact surface suitable to transfer heat from the second press element to a shirt collar, such as to the interior surface of a shirt collar, and a second casing member coupled to the second press element with the second casing member being constructed from a non-thermally conducting material. A portion of a shirt collar may be pressed between the first press element and the second press element and held therein by removably coupling the first casing member to the second casing member.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New apparatuses configured to press the collar of a shirt are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
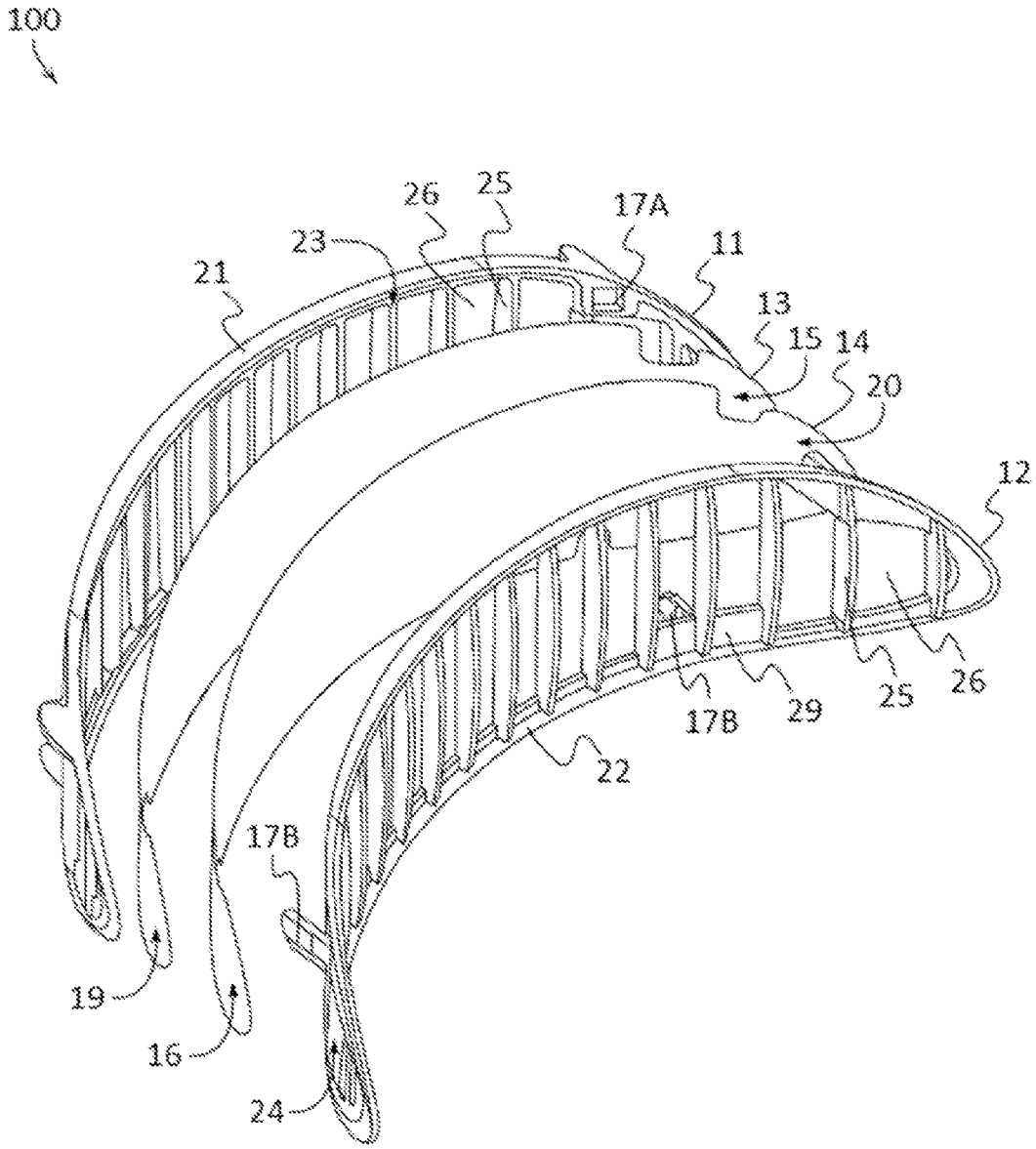
FIG. 1 depicts a perspective exploded view of an example of a collar press apparatus according to various embodiments described herein.

The present invention will now be described by example and through referencing the appended figures representing preferred and alternative embodiments. FIG. 1 illustrates an example of a collar press apparatus ("the apparatus") 100 according to various embodiments. In this example, the apparatus 100 comprises a first casing member 11, a second casing member 12, a first press element 13, and a second press element 14. The first press element 13 may comprise a first garment contacting surface 15 which may be configured to be in thermal communication with a first side of a shirt collar, such as the exterior surface of a shirt collar 201A (FIG. 5), and which may be positioned proximate to the first casing member 11. The second press element 14 may comprise a second garment contacting surface 16 which may be configured to be in thermal communication with a second side of a shirt collar, such as the neck contacting or interior surface of a shirt collar 201B (FIG. 5), and which may be positioned proximate to the second casing member 12. The first casing member 11 and the second casing member 12 may also comprise one or more fasteners 17 which may be configured to removably couple the first casing member 11 and the second casing member 12 together.

Figure 2:
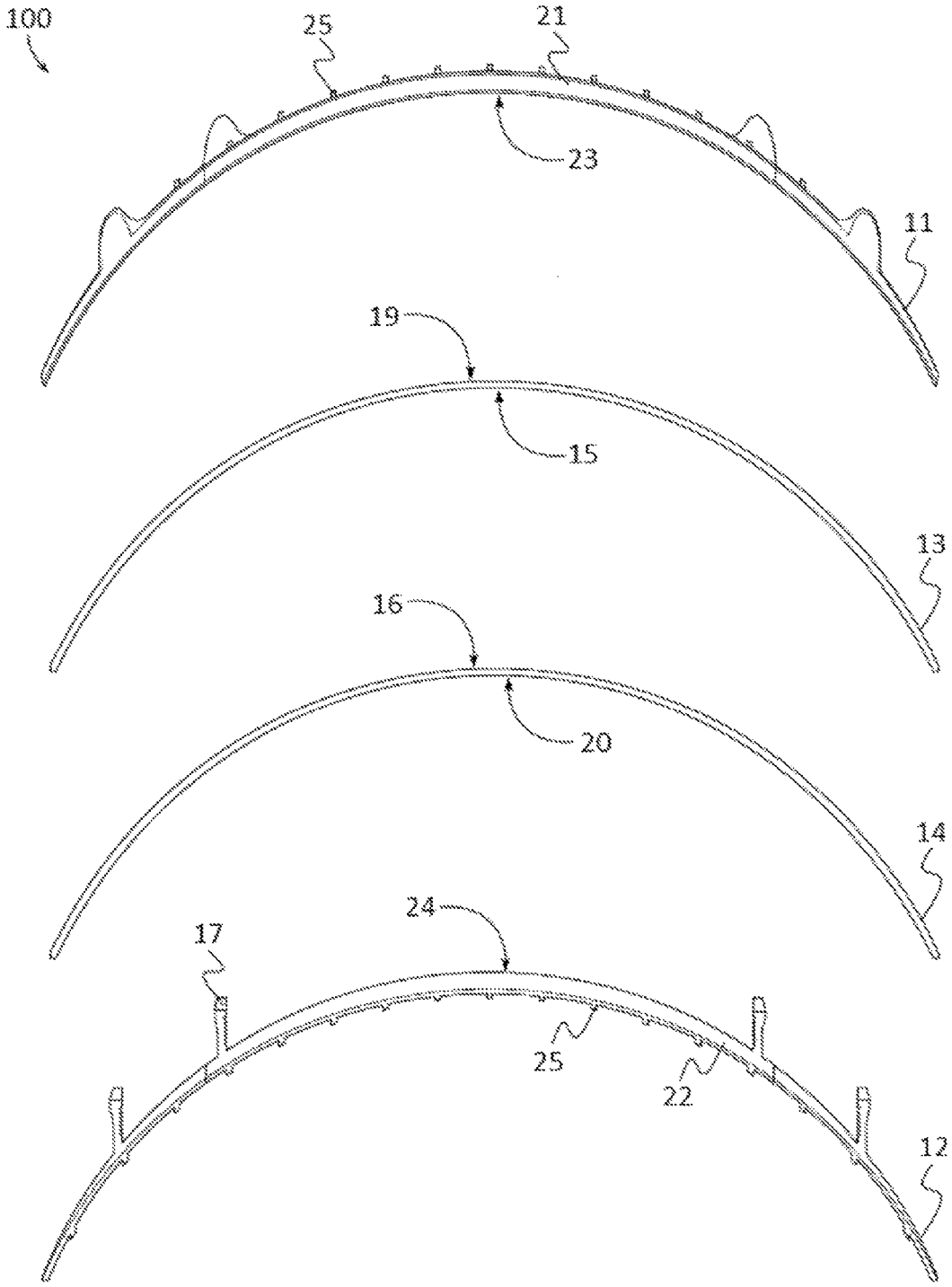
FIG. 2 illustrates a plan exploded view of an example of a collar press apparatus according to various embodiments described herein.

Turning now to both FIG. 1 and FIG. 2, the first press element 13 may comprise a first garment contacting surface 15 and a first casing contacting surface 19. The first casing member 11 may comprise a first perimeter lip 21 which may extend around and frame the first casing member 11. The first casing member 11 may also comprise one or more casing braces 25 which may be configured to provide structural support to the first casing member 11. In some embodiments, one or more casing braces 25 may be coupled to one or more areas of the first perimeter lip 21 and/or one or more other casing braces 25. The first perimeter lip 21 and optionally the casing braces 25 may define one or more first press element contacting surfaces 23 and one, two, three, four, five, six, seven, or more, such as a plurality, of casing vents 26 which may be configured in any shape or size. The first casing member 11 may comprise one or more, such as a plurality of casing vents 26 which may extend through the first casing member 11 thereby allowing air, such as warm air, to pass through the first casing member 11.

The second casing member 12 may comprise a second perimeter lip 22 which may extend around and frame the second casing member 12. The second casing member 12 may also comprise one or more casing braces 25 which may be configured to provide structural support to the second casing member 12. In some embodiments, one or more casing braces 25 may be coupled to one or more areas of the second perimeter lip 22 and/or one or more other casing braces 25. The second perimeter lip 22 and optionally the casing braces 25 may define one or more second press element contacting surfaces 24 and one, two, three, four, five, six, seven, or more, such as a plurality, of casing vents 26 which may be configured in any shape or size. The second casing member 12 may comprise one or more, such as a plurality, of casing vents 26 which may extend through the second casing member 12 thereby allowing air, such as warm air, to pass through the second casing member 12.

Figure 5:
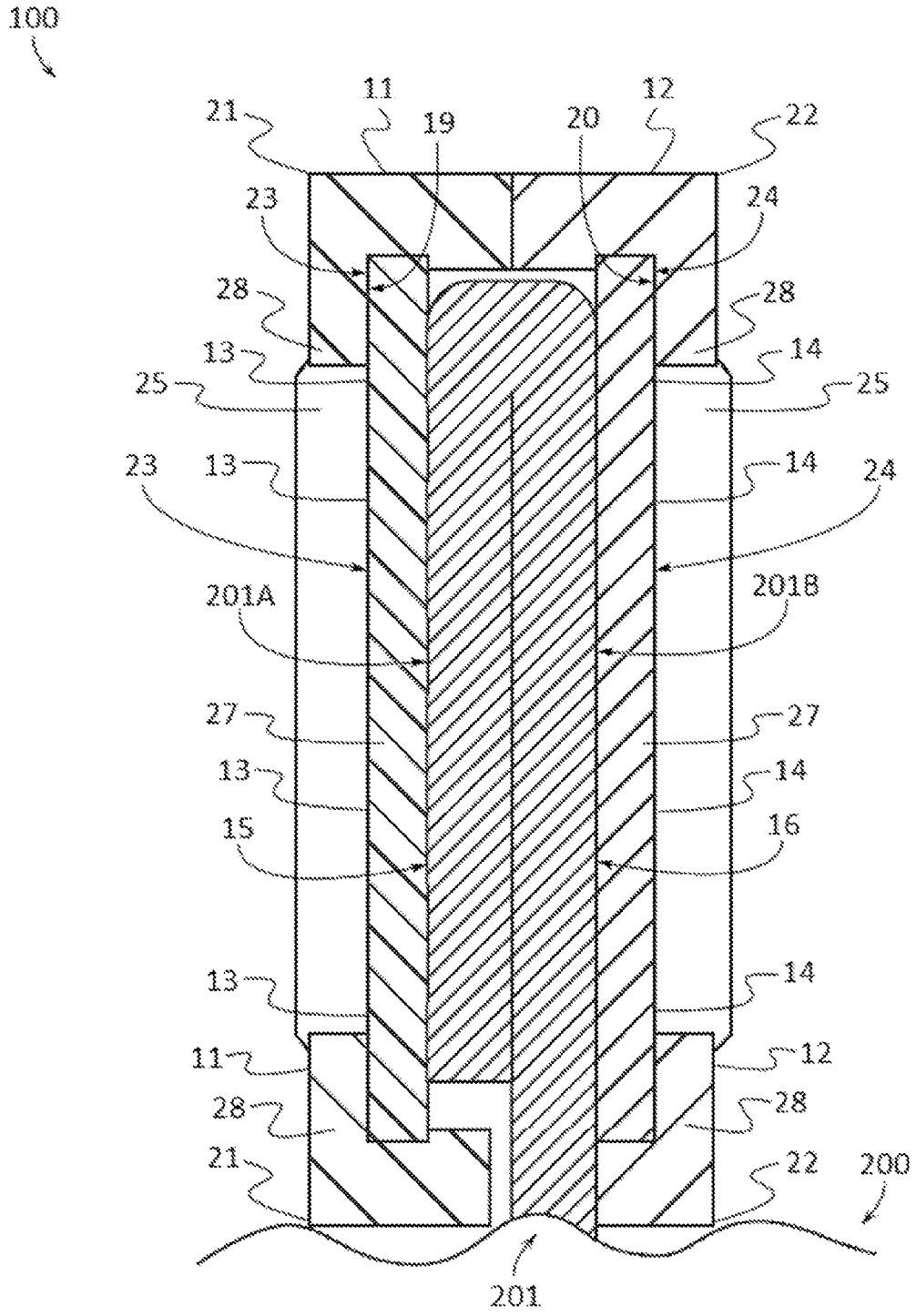
FIG. 5 illustrates a sectional, through line 5-5 shown in FIG. 3, elevation view of an example of collar press apparatus temporarily secured to the collar of a collared shirt according to various embodiments described herein.
Figure 6:
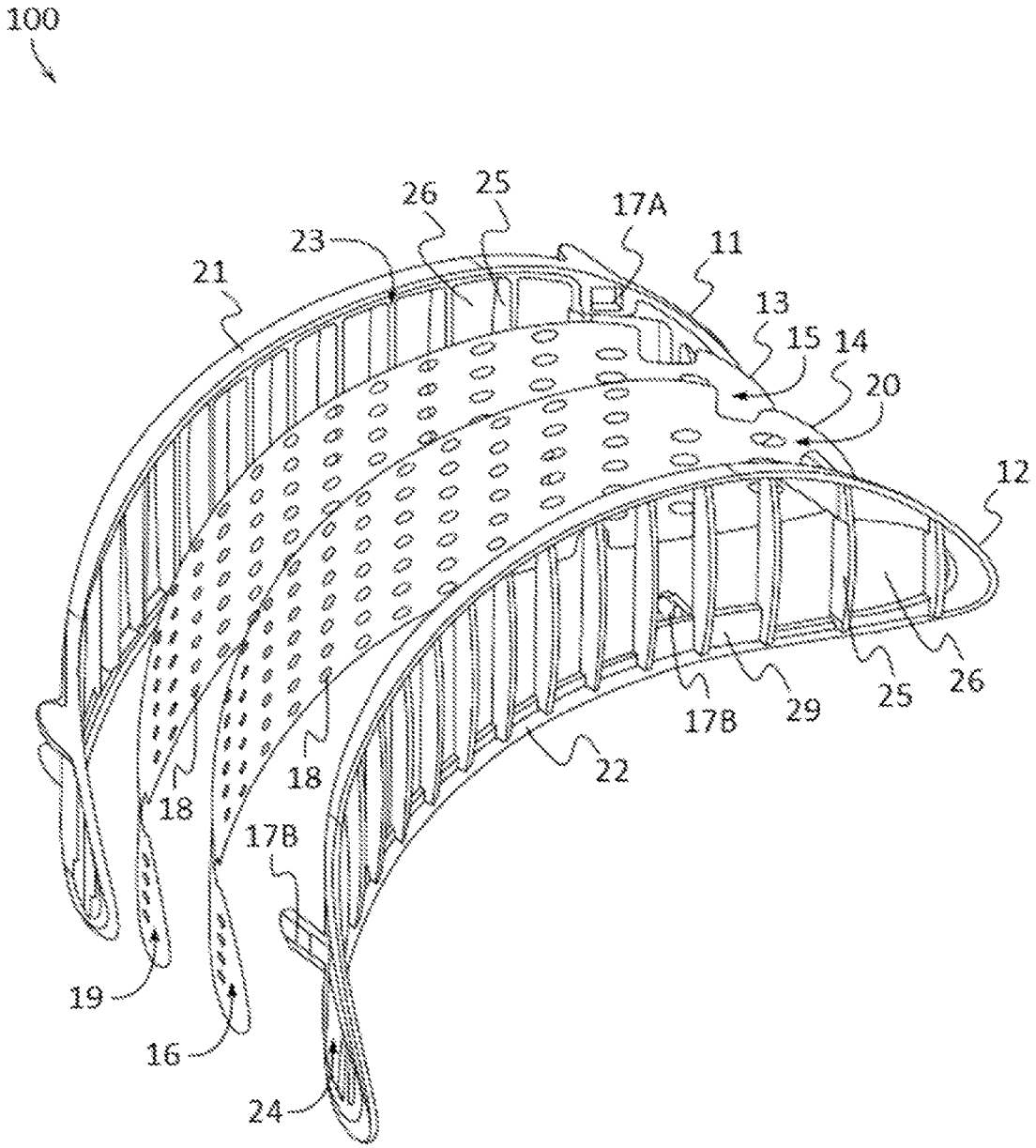
FIG. 6 shows a perspective exploded view of an alternative example of a collar press apparatus according to various embodiments described herein.

In some embodiments, the first casing member 11, second casing member 12, first press element 13, and second press element 14 may comprise a generally flattened crescent or curved shape further comprised of two circular arcs of approximately the same diameters similar to a section of the curved area of an open cylinder allowing them to approximate the curved area of a shirt collar 201 (FIG. 5). The first casing member 11, second casing member 12, first press element 13, and second press element 14 are configured to be complimentary in shape so that they may be nested together. It should be understood to one of ordinary skill in the art that the first casing member 11, second casing member 12, first press element 13, and second press element 14 may be configured in a plurality of sizes and shapes configured to approximate the generally curved or crescent shape common to shirt collars 201 on collared shirts 200, jackets, and the like. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention in which the first casing member 11, second casing member 12, first press element 13, and second press element 14 may be configured to approximate the generally curved or crescent shape common to shirt collars 201.

The first casing member 11 and the second casing member 12 may also comprise one or more fasteners 17 which may be configured to removably couple the first casing member 11 and the second casing member 12 together. By removably coupling one or more fasteners 17 on a first casing member 11 to one or more fasteners 17 on the second casing member 12, the first casing member 11 and the second casing member 12 may be removably coupled together. In some embodiments, a fastener 17 may be positioned on the first perimeter lip 21 of the first casing member 11 and be configured to removably couple to a fastener 17 which may be positioned on the second perimeter lip 22 of the second casing member 12, thereby allowing the first casing member 11 and the second casing member 12 to be removably coupled together with a portion of a shirt collar 201 (FIG. 5) pressed between. In some embodiments, a fastener 17 may be positioned on a casing support 29 which may be formed by an area of a casing member 11, 12, which has been reinforced with extra material which may optionally be coupled to one or more casing braces 25 and/or perimeter lips 21, 22. In further embodiments, the first casing member 11 and the second casing member 12 may be removably coupled together with a male clip type fastener 17B on the second casing member 12 which may be inserted into a female fastener 17A on a first casing member 11. The male clip type fastener 17B may be made from a flexible material and comprise a barb so that when inserted into the female fastener 17A, the male clip type fastener 17B may flex until the barb is through the female fastener 17A at which point the barb may catch onto a portion of the female fastener 17A thereby securing the first casing member 11 and the second casing member 12 together. By pressing on the male clip type fastener 17B, the barb may be removed from catching on the female fastener 17A thereby allowing the first casing member 11 and the second casing member 12 to be separated. In other embodiments, the first casing member 11 and the second casing member 12 may be removably coupled or removably connected by one or more fasteners 17 which may be press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary or removable connection method as one reasonably skilled in the art could envision to serve the same function.

As shown in FIGS. 1, 2, and 5, in some embodiments, the apparatus 100 may comprise a first press element 13 comprising a first garment contacting surface 15 which may be configured to be in thermal communication with a first side of a shirt collar, such as the exterior surface of a shirt collar 201, and which may be positioned proximate to the first casing member 11. The apparatus 100 may also comprise a second press element 14 comprising a second garment contacting surface 16 which may be configured to be in thermal communication with a second side of a shirt collar, such as the neck contacting or interior surface of a shirt collar 202, and which may be positioned proximate to the second casing member 12. The first casing member 11 and the second casing member 12 may also comprise one or more fasteners 17 which may be configured to removably couple the first casing member 11 and the second casing member 12 together.

The first press element 13 may be positioned proximate to the first casing member 11 so that a portion of the first casing contacting surface 19 may contact a portion of the first press element contacting surfaces 23. Similarly, the second press element 14 may be positioned proximate to the second casing member 12 so that a portion of the second casing contacting surface 20 may contact a portion of the second press element contacting surfaces 24. In some embodiments, the press elements 13, 14, may be positioned proximate in order to contact their respective casing member 11, 12, and then secured between the casing members 11, 12, when the fasteners 17 removably couple the casing members together. In other embodiments, the press elements 13, 14, may be positioned proximate to their respective casing member 11, 12, and then the first press element 13 may be coupled to the first casing member 11 and the second press element 14 may be coupled to the second casing member 12, by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary or removable connection method as one reasonably skilled in the art could envision to serve the same function. In still other embodiments, the first press element 13 may be coupled to the first casing member 11 and the second press element 14 may be coupled to the second casing member 12 by being integrally formed or molded with their respective casing member 11, 12, In still other embodiments, the press elements 13, 14, may be positioned proximate to their respective casing member 11, 12, and they may be coupled or connected together with heat bonding, chemical bonding, adhesives, clasp type fasteners, clip type fasteners, rivet type fasteners, threaded type fasteners, other types of fasteners, or any other suitable joining method.

Figure 3:
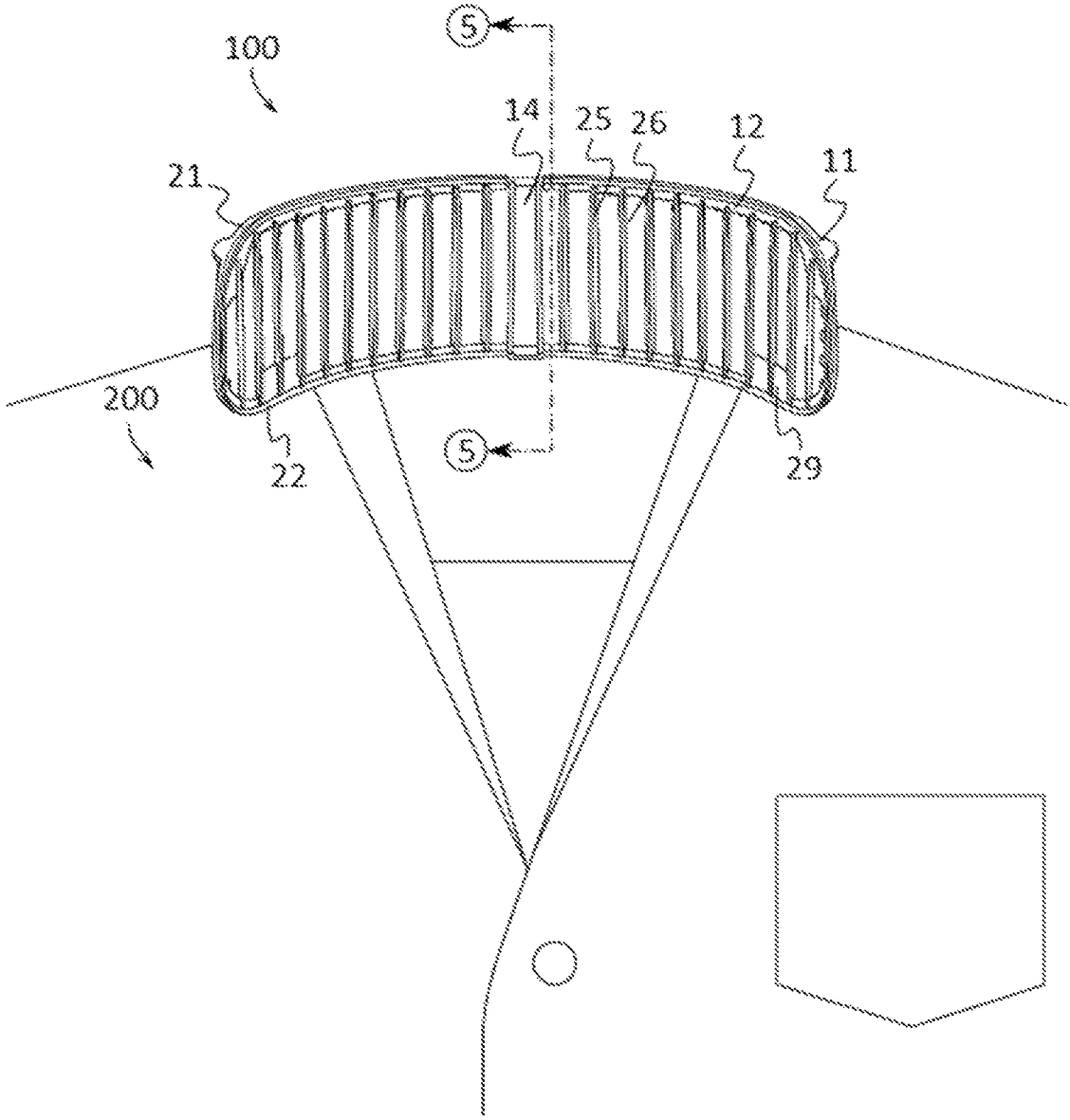
FIG. 3 shows a front perspective view of an example of a collar press apparatus temporarily secured to the collar of a collared shirt according to various embodiments described herein.
Figure 4:
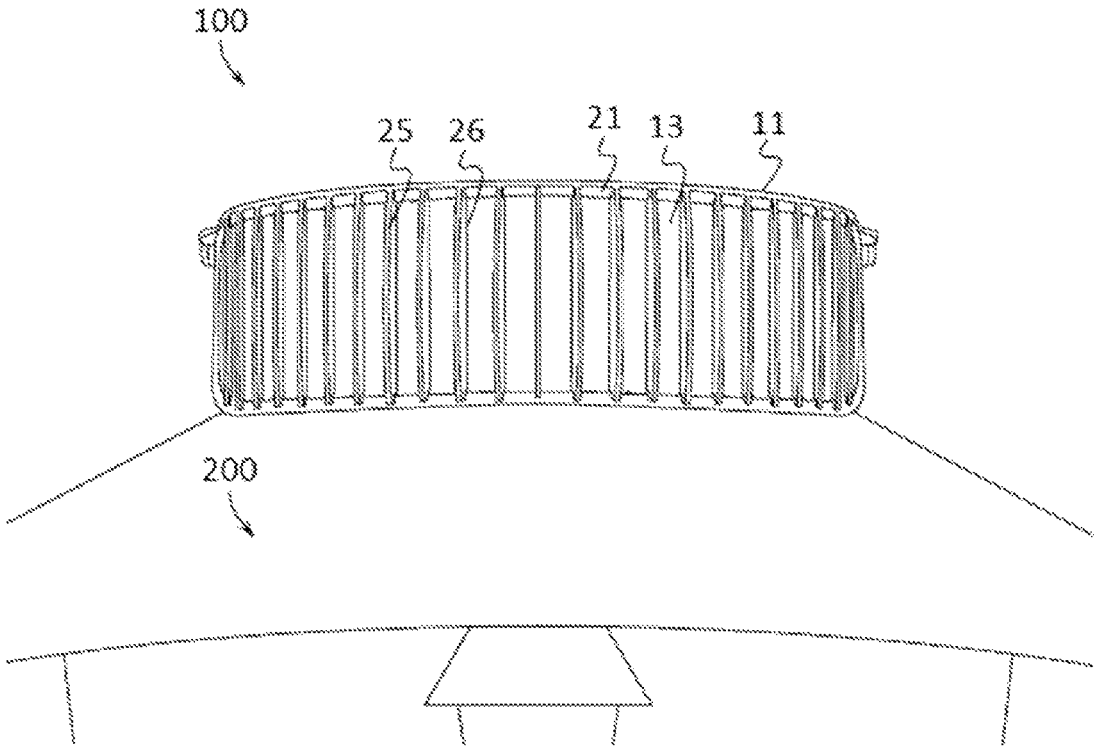
FIG. 4 depicts a back perspective view of an example of a collar press apparatus temporarily secured to the collar of a collared shirt according to various embodiments described herein.

Turning now to FIG. 3, a front perspective view of an example of a collar press apparatus 100 temporarily secured to the collar 201 of a collared shirt 200 and to FIG. 4, a back perspective view of an example of a collar press apparatus 100 temporarily secured to the collar 201 of a collared shirt 200 according to various embodiments described herein is shown. In this example, the apparatus 100 is illustrated secured to the collar 201 of a collared shirt 200 by removably coupling the first casing member 11 and the second casing member 12 with one or more fasteners 17 (FIGS. 1 and 2). The first garment contacting surface 15 (FIGS. 1 and 2) of the first press element 13 (FIGS. 1 and 2) may be configured to be in thermal communication with a first side of a shirt collar, such as the exterior surface of a shirt collar 201A. The first casing contacting surface 19 (FIGS. 1 and 2) of the first press element 13 may be positioned proximate to the first casing member 11 (FIGS. 1 and 2). The second garment contacting surface 16 (FIGS. 1 and 2) of the second press element 14 may be configured to be in thermal communication with a second side of a shirt collar, such as the interior surface of a shirt collar 201B. The second casing contacting surface 20 (FIGS. 1 and 2) of the second press element 14 may be positioned proximate to the second casing member 12. A garment contacting surface 15, 16, (FIGS. 1 and 2) of a press element 13, 14, may be configured to be in thermal communication with a surface of a shirt collar 201 by placing a portion of the garment contacting surface 15, 16, in contact with a surface of a shirt collar 201. By configuring the first casing member 11, second casing member 12, first press element 13, and second press element 14 to comprise a generally flattened crescent shape, the garment contacting surfaces 15, 16, may approximate the curved area of a shirt collar 201 (FIG. 5) allowing the garment contacting surfaces 15, 16, to be in thermal communication with sides of the shirt collar 201 when the apparatus 100 is temporarily secured or removably coupled over a shirt collar 201 as shown in FIGS. 3 and 4.

As perhaps best shown by FIG. 5, a sectional, through line 5-5 shown in FIG. 3, elevation view of an example of collar press apparatus 100 temporarily secured to the collar of a collared shirt according to various embodiments described herein is shown. In this example and in some embodiments, the apparatus 100 may comprise a first press element 13 constructed from a thermally conductive material 27 with a first garment contact surface 15 suitable to transfer heat from the first press element 13 to a shirt collar 201, such as to the exterior surface of a shirt collar 201A, and a first casing member 11 which may be coupled to the first press element 13 with the first casing member 11 being constructed from a non-thermally conducting material 28. The apparatus 100 may further comprise a second press element 14 constructed from a thermally conductive material 27 with a second garment contact surface 16 suitable to transfer heat from the second press element 13 to a shirt collar 201, such as to the interior surface of a shirt collar 201B, and a second casing member 12 coupled to the second press element 14 with the second casing member 12 being constructed from a non-thermally conducting material 28. A portion of a shirt collar 201 may be pressed between the first press element 13 and the second press element 14 and held therein by removably coupling the first casing member 11 to the second casing member 12. As shown in FIG. 5, warm air, such as provided by a clothes dryer, may pass through one or more of the casing vents 26 on a casing member 11, 12, thereby allowing heat to transfer to the press elements 13, 14, and moisture to exit a shirt collar 201 that is pressed between. Additionally, warm air, such as provided by a clothes dryer, may pass through one or more of the casing vents 26 on a casing member 11, 12, and transfer heat to the thermally conductive material 27 of the press element 13, 14, allowing the press element 13, 14, to press a shirt collar 201 that is pressed between.

Thermal communication between the garment contacting surfaces 15, 16, in contact with sides of the shirt collar 201, such as the exterior surface of a shirt collar 201A and interior surface of a shirt collar 201B, when the apparatus 100 is temporarily secured or removably coupled over a shirt collar 201 may be facilitated by a thermally conductive material 27 which may be configured to conduct the heat from hot or warm air, such as provided by a clothes dryer, to the sides of the shirt collar 201. The first press element 13 and the second press element 14 may comprise or be constructed from one or more thermally conductive materials 27 such as steel alloys, aluminum, aluminum alloys, copper, copper alloys, any other type of metal or metal alloy, thermally conductive plastics or polymers, or any other material including combinations of materials that are suitable for conducting heat.

In some embodiments, the first casing member 11 and second casing member 12 may be constructed from a non-thermally conductive material 28 which may optionally remain generally cool or cooler to the touch than the thermally conductive material 27 which may be used to construct the press elements 13, 14. In further embodiments, the first casing member 11 and second casing member 12 may be constructed from one or more non-thermally conductive materials 28 such as Acrylonitrile butadiene and styrene (A.B.S.) plastics, acetate, acrylic, ceramic, delrin, other thermally insulating plastics, silicone foams, rubber foams, plastic foams, neoprene foam, latex foam rubber, polyurethane foam rubber, or elastomer materials such as elastic plastics, elastic silicone, elastic rubbers, silicone rubbers, natural rubber, or any other suitable non-thermally conductive material.

Turning now to FIGS. 6-9, an alternative example of a collar press apparatus 100 according to various embodiments described herein is shown. In some embodiments, the first press element 13 may also comprise one, two, three, four, five, six, seven, or more, such as a plurality, of press apertures 18 which may be configured in any shape or size. The press apertures 18 may extend through the first press element 13 thereby allowing air, such as hot air, to pass between the first garment contacting surface 15 and first casing contacting surface 19. Similarly, the second press element 14 may comprise a second garment contacting surface 16 and a second casing contacting surface 20. The second press element 14 may also comprise one, two, three, four, five, six, seven, or more, such as a plurality, of press apertures 18 which may be configured in any shape or size. The press apertures 18 may extend through the second press element 14 thereby allowing air, such as warm air, to pass between the second garment contacting surface 16 and second casing contacting surface 20.

Figure 7:
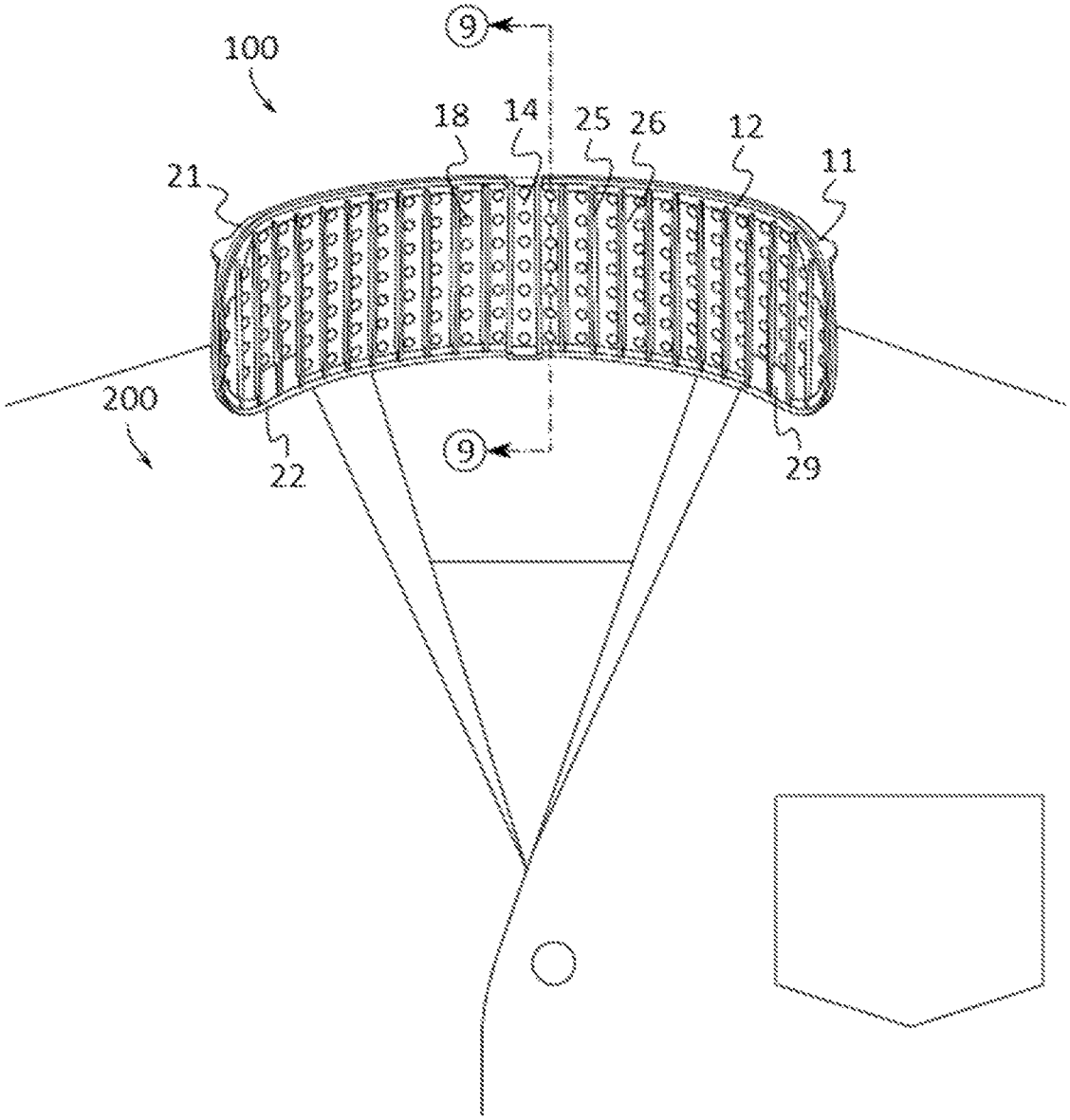
FIG. 7 depicts a front perspective view of an alternative example of a collar press apparatus temporarily secured to the collar of a collared shirt according to various embodiments described herein.
Figure 8:
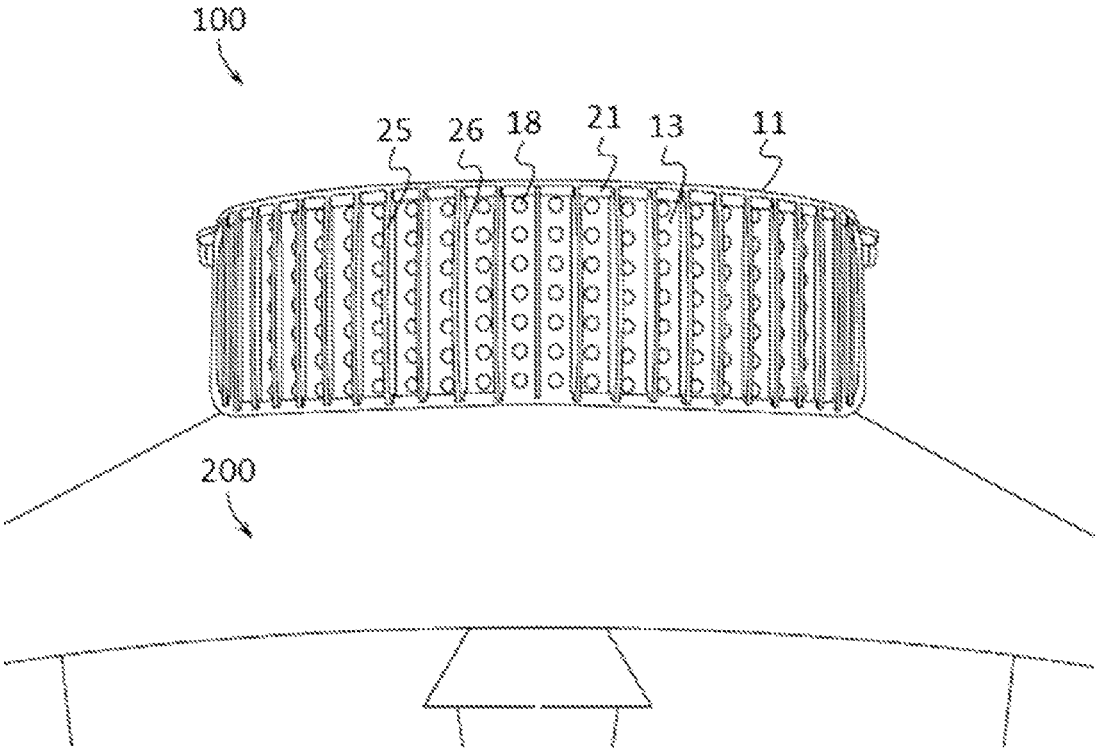
FIG. 8 illustrates a back perspective view of an alternative example of a collar press apparatus temporarily secured to the collar of a collared shirt according to various embodiments described herein.
Figure 9:
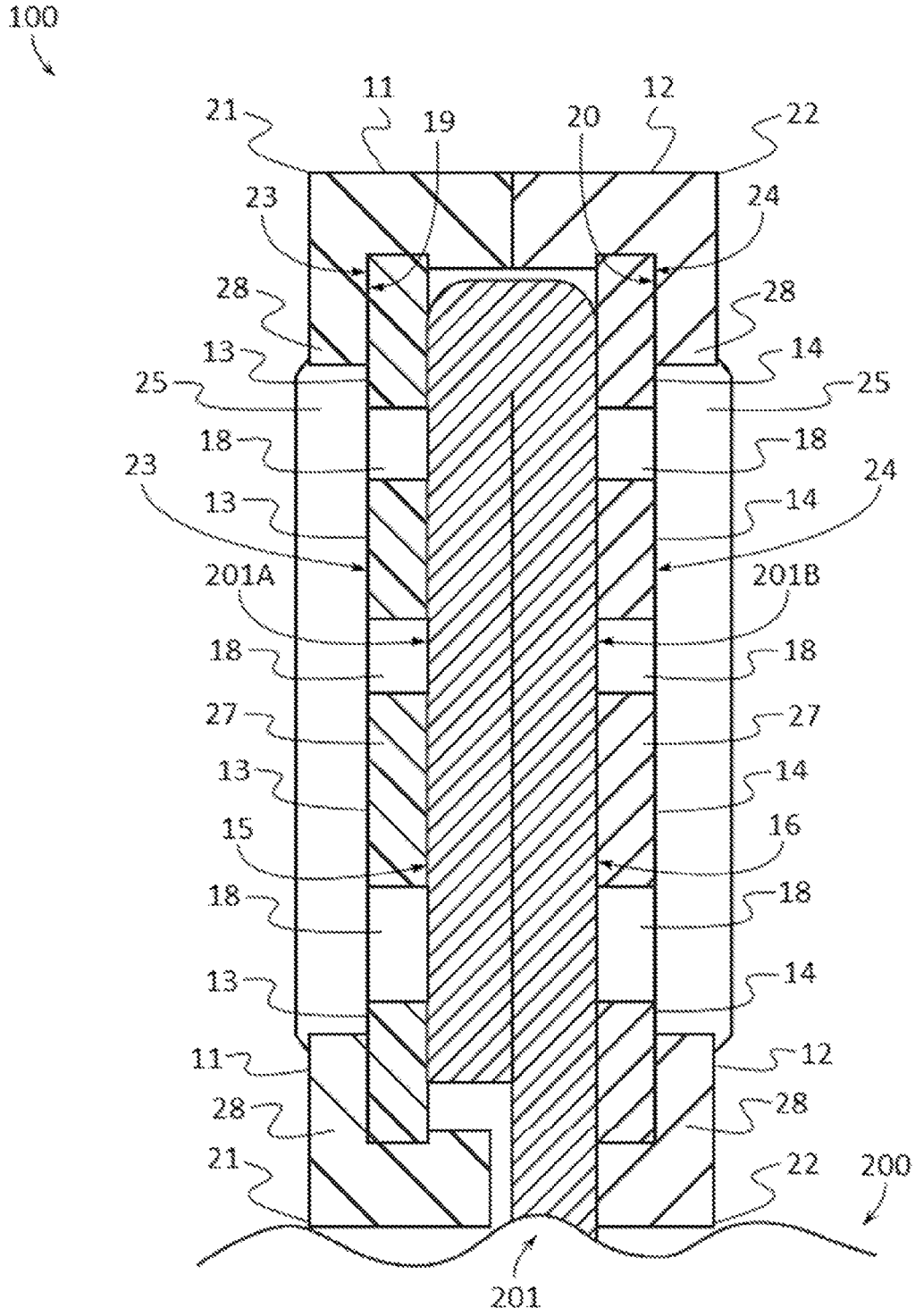
FIG. 9 shows a sectional, through line 9-9 shown in FIG. 7, elevation view of an alternative example of collar press apparatus temporarily secured to the collar of a collared shirt according to various embodiments described herein.

In FIG. 9, a sectional, through line 9-9 shown in FIG. 7, elevation view of an alternative example of collar press apparatus 100 temporarily secured to the collar of a collared shirt according to various embodiments described herein is shown. In this example and in some embodiments, the apparatus 100 may comprise a first press element 13 constructed from a thermally conductive material 27 with a first garment contact surface 15 suitable to transfer heat from the first press element 13 to a shirt collar 201, such as to the exterior surface of a shirt collar 201A, and a first casing member 11 which may be coupled to the first press element 13 with the first casing member 11 being constructed from a non-thermally conducting material 28. The apparatus 100 may further comprise a second press element 14 constructed from a thermally conductive material 27 with a second garment contact surface 16 suitable to transfer heat from the second press element 13 to a shirt collar 201, such as to the interior surface of a shirt collar 201B, and a second casing member 12 coupled to the second press element 14 with the second casing member 12 being constructed from a non-thermally conducting material 28. A portion of a shirt collar 201 may be pressed between the first press element 13 and the second press element 14 and held therein by removably coupling the first casing member 11 to the second casing member 12. As shown in FIG. 9, warm air, such as provided by a clothes dryer, may pass through one or more of the casing vents 26 on a casing member 11, 12, to the press elements 13, 14, and through one or more of the press apertures 18 on a press element 13, 14, thereby allowing moisture to exit a shirt collar 201 that is pressed between. Additionally, warm air, such as provided by a clothes dryer, may pass through one or more of the casing vents 26 on a casing member 11, 12, and transfer heat to the thermally conductive material 27 of the press element 13, 14, allowing the press element 13, 14, to press a shirt collar 201 that is pressed between.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A collar press apparatus, the apparatus comprising:

a) a first casing member;

b) a first press element positioned proximate to said first casing member and having a first garment contacting surface configured to be in thermal communication with a first side of a shirt collar;

c) a second press element having a second garment contacting surface configured to be in thermal communication with a second side of a shirt collar; and d) a second casing member positioned proximate to said second press element; and wherein the first casing member and the second casing member each comprise a plurality of casing vents configured to allow warm air contacting the apparatus to heat the first press element and the second press element.

2. The apparatus of claim 1, wherein the first press element is coupled to the first casing member and the second press element is coupled to the second casing member.

3. The apparatus of claim 1, wherein the first casing member comprises a fastener and the second casing comprises a fastener.

4. The apparatus of claim 3, wherein the fastener of the first casing member is removably coupled to the fastener of the second casing member.

5. The apparatus of claim 1, wherein the first casing member, second casing member, first press element, and second press element comprise a flattened crescent shape.

6. The apparatus of claim 1, wherein the first press element and second press element are constructed from a thermally conductive material.

7. The apparatus of claim 6, wherein the thermally conductive material is selected from one of thermally conductive plastic, aluminum, and copper.

8. The apparatus of claim 1, wherein the first casing member and second casing member is constructed from a non-thermally conductive material.

9. The apparatus of claim 8, wherein the non-thermally conductive material is selected from one of thermally insulating plastic, silicone, and rubber.

10. The apparatus of claim 1, wherein the first press element and second press element each comprise a plurality of press apertures.

11. An apparatus for pressing the collar of a shirt, the apparatus comprising:

a) a first press element constructed from a thermally conductive material with a first garment contact surface suitable to transfer heat from the first press element to a shirt collar;

b) a first casing member coupled to said first press element with said first casing member being constructed from a non-thermally conducting material;

c) a second press element constructed from a thermally conductive material with a second garment contact surface suitable to transfer heat from the second press element to a shirt collar; and d) a second casing member coupled to said second press element with said second casing member being constructed from a non-thermally conducting material, wherein a portion of a shirt collar may be pressed between the first press element and the second press element and held therein by removably coupling the first casing member to the second casing member; and wherein the first casing member and the second casing member each comprise a plurality of casing vents configured to allow warm air contacting the apparatus to heat the first press element and the second press element.

12. The apparatus of claim 11, wherein the first casing member comprises a fastener and the second casing comprises a fastener.

13. The apparatus of claim 12, wherein the fastener of the first casing member is removably coupled to the fastener of the second casing member.

14. The apparatus of claim 13, wherein the thermally conductive material is selected from one of thermally conductive plastic, aluminum, and copper.

15. The apparatus of claim 13, wherein the non-thermally conductive material is selected from one of thermally insulating plastic, silicone, and rubber.

16. The apparatus of claim 13, wherein the first casing member, second casing member, first press element, and second press element comprise a generally crescent shape.

17. The apparatus of claim 13, wherein the casing member comprises a perimeter lip, casing support, and a plurality of casing vents.

18. The apparatus of claim 13, wherein the press element comprises a plurality of press apertures.

* * * * *